US006558577B1

(12) United States Patent
Niihara et al.

(10) Patent No.: US 6,558,577 B1
(45) Date of Patent: May 6, 2003

(54) DEFORMABLE CONDUCTIVE ELASTOMER AND MANUFACTURING METHOD THEREOF

(75) Inventors: Koichi Niihara, 18-1-608 Yamadahigashi 3-chome, Suita-shi-Osaka 565-0821 (JP); Yong-Ho Choa, Suita (JP); Manwar Hussain, Toyonaka (JP); Hiroshi Nishida, Ideda (JP); Yoshiyuki Hamahashi, Osaka (JP); Kotaro Kawahara, Osaka (JP)

(73) Assignees: Koichi Niihara, Osaka (JP); Inabagomu Co. Ltd., Osaka (JP)

( * ) Notice: Subject to any disclaimer, the term of this patent is extended or adjusted under 35 U.S.C. 154(b) by 0 days.

(21) Appl. No.: 09/546,861

(22) Filed: Apr. 10, 2000

(30) Foreign Application Priority Data

Apr. 15, 1999 (JP) ..... 11-147038

(51) Int. Cl.[7] ..... H01B 1/24
(52) U.S. Cl. ..... 252/511
(58) Field of Search ..... 252/500, 511, 252/512, 514

(56) References Cited

U.S. PATENT DOCUMENTS 5,229,037 A * 7/1993 Nakano et al. ..... 252/512
5,458,937 A * 10/1995 Nakamura et al. ..... 428/36.91
5,536,568 A * 7/1996 Teruo ..... 428/327

FOREIGN PATENT DOCUMENTS

JP 04349301 A2 * 12/1992
JP 10154416 A2 * 6/1998

* cited by examiner

*Primary Examiner*—Mark Kopec
(74) *Attorney, Agent, or Firm*—Wolf, Greenfield & Sacks, P.C.

(57) ABSTRACT

A deformable conductive elastomer excellent in reliability, linearity, and mechanical characteristics, and a manufacturing method thereof are provided. Elastomer particles with a particle size of 10 through 300 μm and conductive particles with a particle size of 10 through 40 μm are almost uniformly dispersed in a non-conductive elastomer. Ceramic particles with a particle size of 1000 nm or less are also almost uniformly dispersed in the non-conductive elastomer. At least the non-conductive elastomer uncrosslinked, the elastomer particles, and the conductive particles are added to the dispersion medium, and the mixture is vibrated, mixed, and dried to crosslink the uncrosslinked non-conductive elastomer. At least the non-conductive elastomer, the elastomer particles, and the conductive particles are added to the dispersion medium, and the mixture is vibrated, mixed, and dried.

6 Claims, 5 Drawing Sheets

The case where a dissolvable solvent is used

DEFORMABLE CONDUCTIVE ELASTOMER AND MANUFACTURING METHOD THEREOF

BACKGROUND OF THE INVENTION

1. Field of the Invention

The present invention relates to a deformable conductive elastomer configured so as to exhibit a high electric resistance value in a state of non-deformations such as non-pressurization and non-elongation, while exhibiting a well reduced electric resistance value at the time of deformations such as compression, elongation, torsion, and bending, and a manufacturing method thereof.

2. Description of the Prior Art

As this type of deformable conductive elastomer in the prior art, there is known, for example, one obtained by dispersing elastomer particles with a particle size of 10 through 300 $\mu$m, conductive particles with a particle size of 10 through 40 $\mu$m, and hollow elastic microspheres with a particle size of 10 through 150 $\mu$m in a non-conductive elastomer, as disclosed in Japanese Patent Publication No. Hei 7-7607.

However, the prior-art deformable conductive elastomer as described above has the following problem in that the dispersibility of the conductive particles and the like is unsatisfactory, the variation characteristics of the electric resistance value with respect to repeated changes in pressure are unstable, and hence the reliability is not high.

Further, there are other problems as follows. Since wettability (adhesive strength) of the non-conductive elastomer which is a matrix, and the conductive particles are also unsatisfactory, a desired linearity cannot be imparted to the variation characteristics of the electric resistance value with respect to a change in pressure, as well as the mechanical characteristics such as the elongation percentage and tensile strength are also unsatisfactory.

SUMMARY OF THE INVENTION

The present invention has been achieved in view of the foregoing problems. It is therefore an object of the present invention to provide a deformable conductive elastomer excellent in reliability, linearity, and mechanical characteristics, and a manufacturing method thereof.

A deformable conductive elastomer according to a first aspect of the present invention for solving the foregoing problems is characterized in that elastomer particles with a particle size of 10 through 300 $\mu$m and conductive particles with a particle size of 10 through 40 $\mu$m are almost uniformly dispersed in a non-conductive elastomer.

The deformable conductive elastomer according to the second aspect of the invention is characterized in that ceramic particles with a particle size of 1000 nm or less are also almost uniformly dispersed in the non-conductive elastomer.

The deformable conductive elastomer according to the third aspect of the invention is characterized in that the non-conductive elastomer is a silicone rubber.

The deformable conductive elastomer according to the fourth aspect of the invention is characterized in that the silicone rubber is one obtained by crosslinking a mixture of a silicone varnish and an uncrosslinked silicone rubber, or a silicone adhesive containing the silicone varnish and the uncrosslinked silicone rubber as main components, and a liquid silicone rubber.

The deformable conductive elastomer according to the fifth aspect of the invention is characterized in that the elastomer particles are of a silicone rubber powder.

The deformable conductive elastomer according to the sixth aspect of the invention is characterized in that the conductive particles are spherical carbon particles.

A manufacturing method of a deformable conductive elastomer according to the seventh aspect of the invention, which is the manufacturing method of the deformable conductive elastomer described in any of the first through sixth aspects, is characterized by the steps of: adding at least the non-conductive elastomer uncrosslinked, the elastomer particles, and the conductive particles to a dispersion medium, vibrating, mixing, and drying the mixture to crosslink the uncrosslinked non-conductive elastomer.

The manufacturing method of the deformable conductive elastomer according to the eighth aspect of the invention is characterized in that the dispersion medium is a solvent in which the uncrosslinked non-conductive elastomer is dissolved.

The manufacturing method of the deformable conductive elastomer according to the ninth aspect of the invention is characterized in that the uncrosslinked non-conductive elastomer is a liquid rubber or an uncrosslinked rubber varnish.

A manufacturing method of a deformable conductive elastomer according to the tenth aspect of the invention, which is the manufacturing method of the deformable conductive elastomer described in the first, second, fifth, or sixth aspect of the invention, is characterized by the steps of: adding at least the non-conductive elastomer, the elastomer particles, and the conductive particles to a dispersion medium, vibrating, mixing, and drying the mixture.

The manufacturing method of the deformable conductive elastomer according to the eleventh aspect of the invention is characterized in that the dispersion medium is a solvent in which the non-conductive elastomer is dissolved.

The manufacturing method of the deformable conductive elastomer according to the twelfth aspect of the invention is characterized in that the non-conductive elastomer is a thermoplastic elastomer varnish.

DETAILED DESCRIPTION OF THE PREFERRED EMBODIMENTS

Figure 1:
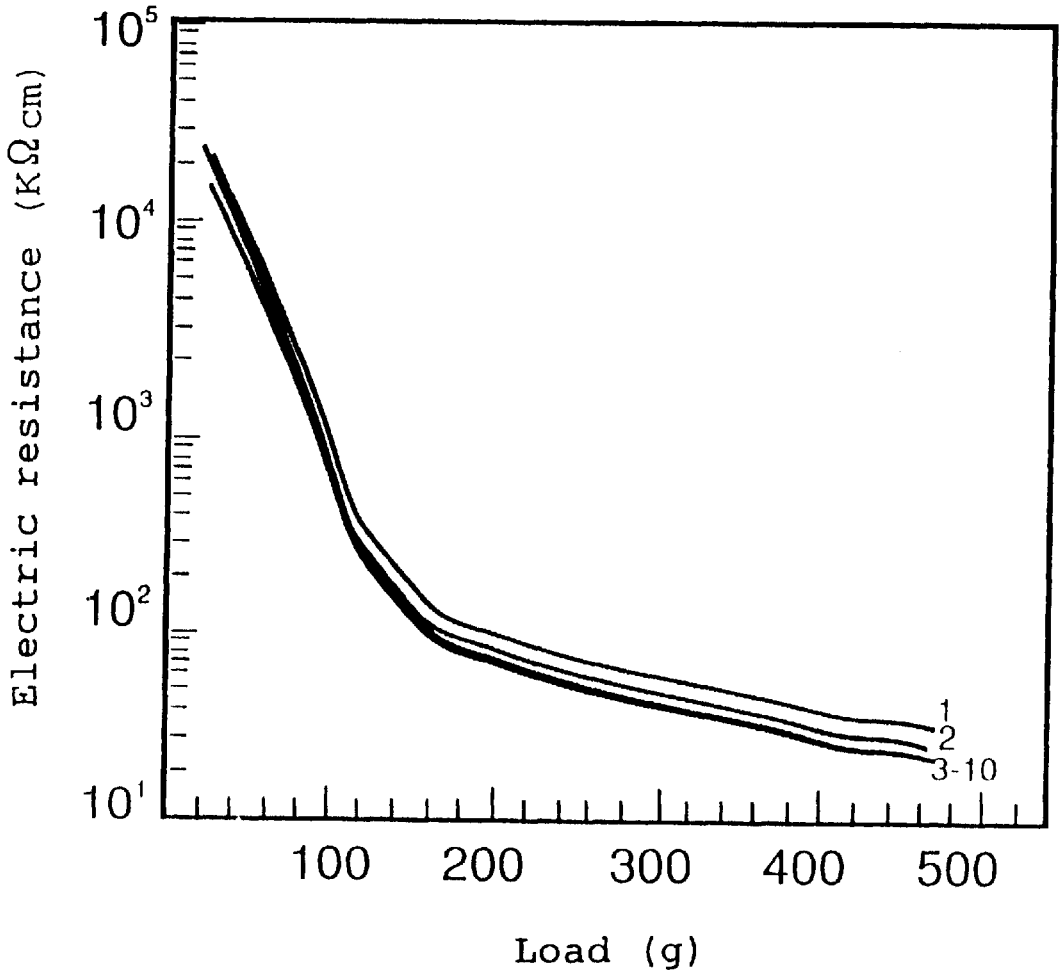
FIG. 1 is a graph showing the electric resistance variation characteristics against repeated compression deformations of Example 1.

Hereinafter, the present invention will be described by way of embodiments.

The deformable conductive elastomer in accordance with this embodiment is the one obtained by almost uniformly dispersing elastomer particles with a particle size of 10 through 300 μm and conductive particles with a particle size of 10 through 40 μm in a non-conductive elastomer.

The aforesaid non-conductive elastomer is a non-conductive polymeric substance which exhibits a rubber elasticity at ordinary temperature. Examples thereof include crosslinked rubbers and thermoplastic elastomers.

Examples of the crosslinked rubbers include natural rubber, or synthetic rubbers such as silicone rubber, styrene-butadiene rubber (SBR), nitrile rubber, butadiene rubber, and chloroprene rubber.

Examples of the thermoplastic elastomers include various thermoplastic elastomers of olefin, urethane, vinyl chloride, and polyester series, etc.

Here, when the non-conductive elastomer serving as a matrix is a silicone rubber, the deformable conductive elastomer has advantages of being excellent in heat resistance, aging resistance, tracking resistance, cold resistance, and oil resistance. The silicone rubber is preferably a one-component cold-crosslinking silicone rubber. As a one-component cold-crosslinking silicone rubber, there may be mentioned, as an example, that of a condensation type which undergoes hydrolysis by moisture in air to facilitate. crosslinking. The oxime type, alcohol type, acetone type, acetate type, and the like can be used. Out of these, since the acetone type and acetate type have inferior characteristics in terms of crosslinking speed, corrosiveness, odor, and the like, the oxime type and alcohol type are preferably used.

Further, when the liquid silicone rubber as described above is used, a silicone varnish obtained by diluting polysiloxane with an organic solvent such as toluene or xylene, and an uncrosslinked silicone rubber comprising a straight-chain polysiloxane having an average molecular weight of 150,000 to 500,000 are mixed to the liquid silicone rubber. Alternatively, a silicone adhesive comprising, as main components, the silicone varnish to which a filler, plasticizer, and the like have been added and mixed, and the uncrosslinked silicone rubber are mixed to the liquid silicone rubber. The resulting mixture has advantages in that wettability (adhesive strength) of the matrix and conductive particles, and the tear strength, and the like of the deformable conductive elastomer can be improved as compared with the case of the liquid silicone rubber alone.

The aforesaid elastomer particles are the particles of the elastomer comprising the crosslinked rubber or thermoplastic elastomer as described above. When these elastomer particles are mixed and dispersed in the non-conductive elastomer serving as a matrix, an ocean-island structure is constructed (polymer alloy is achieved). Consequently, the hardness which would increase due to the addition of conductive particles is reduced, and the maximum limit of the amount of elongation, and rubber elasticity are increased, and hence the deformable conductive elastomer can be prevented from becoming brittle. Further, the strength against deformations such as elongation, torsion, and bending in addition to compression deformation is sufficient, and the electric resistance value satisfactorily varies with respect to all these deformations. Still further, since the elastomer particles are dispersed almost uniformly, the deformable conductive elastomer has the advantages of being more excellent in linearity in variations of the electric resistance value, and mechanical characteristics.

Examples of the elastomer particles include particles of synthetic rubbers such as silicone rubber, fluoro rubber, ethylene propylene diene rubber (EPDM), acrylonitrile rubber, chloroprene rubber, and styrene butadiene rubber (SBR), or particles of thermoplastic elastomers such as a copolymer of polystyrene and butadiene rubber, a copolymer of polyethylene and ethylene propylene rubber, and a copolymer of polyurethane and polyester. Amorphous or spherical particulate substances manufactured by grinding with a low-temperature grinding machine, abrasion type milling machine, or the like can be used.

When the non-conductive elastomer is a silicone rubber, the elastomer particles are also preferably of a silicone rubber powder in terms of wettability and the like. However, when other elastomer particles are used, it is also possible to perform an adequate surface treatment by a silane coupling agent, or the like.

It is noted that the particle size of the elastomer particle is required to fall within the range of 10 through 300 μm. Especially, it is preferably in the range of 50 to 100 μm from the viewpoint of the elongation deformation. When the particle size is less than 10 μm, grinding thereof is difficult, and the effect of reinforcement cannot satisfactorily be expected, and hence such a particle size is not preferred. When the particle size exceeds 300 μm, the dispersibility of the conductive particles is reduced, and the reliability of the deformable conductive elastomer is also reduced, and hence such a particle size is not preferred.

The mixing ratio of the elastomer particles based on the total amount of the composition has no particular restriction. The elastomer particles may be added within such a range as not to make the deformable conductive elastomer brittle or too soft, in accordance with the particle size, mixing ratio, and the like of the conductive particles or ceramic particles.

Examples of the conductive particles include particles of metals such as nickel, copper, gold, silver, stainless steel, aluminum, iron, chromium, or alloys of adequate combinations of these, graphite, and carbon particles. Further, since these conductive particles are almost uniformly dispersed in the non-conductive elastomer, the deformable conductive elastomer has an advantage of having a higher reliability in variation in electric resistance value thereof.

Here, when the conductive particles are spherical carbon particles, the deformable conductive elastomer has an advantage in that a uniform change in characteristics in three dimensional directions with respect to every deformation such as compression, elongation, torsion, or bending is exhibited.

The spherical carbon particles may be, for example, mesocarbon microbeads produced by heating microspheres of, for example, polystyrene, polyvinyl chloride, polyvinylidene chloride, and the like in air up to 300° C., and then heating and burning them up to 1000° C. in an inert gas. Alternatively, they may be glass-like carbon particles each in a microsphere form (independent particles each close to a perfect circle) produced by subjecting microspheres of phenolic resin, furan resin, or the like to a heat-treatment at 800 to 1000° C. in a vacuum.

It is noted that the particle size of the conductive particle is required to fall within the range of 1 to 40 μm. When the particle size is less than 1 μm, manufacture of the particle is difficult, and the variation in electric resistance value is reduced, and hence such a particle size is not preferred. When the particle size exceeds 40 μm, the variation in electric resistance value becomes too large, and hence such a particle size is not preferred.

The mixing ratio of the conductive particles based on the total amount of the composition is preferably in the range of 20 to 55 vol %. When it is less than 20 vol %, the electric resistance value increases. When it exceeds 55 vol %, the ordinary conduction state tends to occur. Thus, both the cases are not preferred.

Wettability of the conductive particles and the non-conductive elastomer can be improved by a means of such an adequate surface treatment of the conductive particles. As the surface treatment, when conductive particles are spherical carbon particles, for example, there is adhesion of insulating particles with a particle size of 0.05 to 0.2 $\mu$m onto the surface of the spherical carbon particles at a surface integral ratio of 30 to 70%. Examples of the insulating particles include ultrafine particles of calcium oxide, titanium oxide, silicon oxide, and the like. If the insulating particles are allowed to adhere to the surface of the conductive particles at an adequate surface integral ratio in this manner, wettability of the conductive particles and the non-conductive elastomer are improved, and the degree to which the conduction state occurs when the conductive particles come in contact with each other is adequately relieved. As a result, advantageously, the variation in electric resistance value with respect to the deformation of the deformable conductive elastomer becomes moderate, and the linearity is also improved.

Here, if the ceramic particles with a particle size of 1000 nm or less:are also dispersed almost uniformly in the non-conductive elastomer, the linearity in the variation in electric resistance value of the deformable conductive elastomer is enhanced, and wettability of the matrix and the conductive particles are improved. As a result, advantageously, the mechanical characteristics such as elongation percentage and tensile strength can also be improved. It is noted that the ceramic particles and the conductive particles may also aggregate to a certain degree, and in this case, it is desirable that the aggregate be almost uniformly dispersed.

Examples of the ceramic particles include ceramic particles based on various oxides such as $Al_2O_3$, $SiO_2$, MgO, and $ZrO_2$, or ceramic particles based on various non-oxides such as SiC, TiC, WC, $TiB_4$, AlN, $Si_3N_4$, and SIALON.

The particle size of the ceramic particle is required to be 1000 nm or less. When the particle size exceeds 1000 nm, the linearity in the variations of the electric resistance value and the mechanical characteristics of the deformable conductive elastomer are not improved, and hence such a particle size is not preferred. Further, it is desirable that the mixing ratio of the ceramic particles based on the total amount of the composition is 10 vol % or less, preferably 5 vol % or less, and more preferably 3 vol % or less. When the mixing ratio exceeds 10 vol %, contrarily, the mechanical characteristics are reduced, and hence such a ratio is not preferred.

Hereinafter, a description will be given to the manufacturing method of the deformable conductive elastomer configured as described above.

When the non-conductive elastomer is comprised of a crosslinked rubber, at least an uncrosslinked non-conductive elastomer, elastomer particles, and conductive particles may be added to the dispersion medium, and vibrated for a prescribed time so as to be mixed. Subsequently, the solvent was removed by distillation for drying to crosslink the uncrosslinked non-conductive elastomer. Ceramic particles may be added to the dispersion medium, if required.

As for the dispersion medium, various liquid mediums can be used. The uncrosslinked non-conductive elastomer, and the like may be added to this dispersion medium and continue the vibration for several minutes to several hours. In this case, a part of the elastomer particles may be dissolved.

As for the vibration, there may be mentioned, for example, the vibration caused by ultrasonic irradiation. However, the vibration is not limited thereto, and any one which can impart a vibration with an adequate frequency to the dispersion medium can be adopted.

Thus, since the elastomer particles, conductive particles, and the like are mixed and dispersed by the vibration in the dispersion medium, and the drying process, there is an advantage in that these can be dispersed more uniformly.

Here, when the dispersion medium is a solvent such as hexane, toluene, or xylene, in which the uncrosslinked non-conductive elastomer is dissolved, there is an advantage in that the dissolution of the uncrosslinked non-conductive elastomer into the solvent enables more uniform dispersion of the elastomer particles, conductive particles, and the like. Further, in this case, when the uncrosslinked non-conductive elastomer is a liquid rubber, or an uncrosslinked rubber varnish, since it is easily dissolved in the solvent, or even only the diluting thereof with the solvent is sufficient, there is an advantage in that the deformable conductive elastomer can be manufactured more efficiently.

When the non-conductive elastomer is a thermoplastic elastomer, at least a non-conductive elastomer, elastomer particles, and conductive particles are added to the dispersion medium, and vibrated to be mixed, followed by drying. Ceramic particles may also be added to the dispersion medium, if required, in this case.

It is also sufficient as described above to carry out the vibration for several minutes to several hours after adding the non-conductive elastomer, and the like to the dispersion medium. A part of the elastomer particles may also be dissolved in this case. It is noted that, since thermoplastic elastomer is used, the crosslinking process after drying is not required.

In addition, when the dispersion medium is a solvent in which the non-conductive elastomer is dissolved, there is an advantage in that the dissolution of the non-conductive elastomer in the solvent enables more uniform dispersion of the elastomer particles, conductive particles, and the like. Further, in this case, when the non-conductive elastomer is a thermoplastic rubber varnish, since only the diluting thereof with the solvent is sufficient, there is an advantage in that the deformable conductive elastomer can be manufactured more efficiently.

EXAMPLES

Next, the present invention will be described in more detail by way of examples, which should not be construed as limiting the scope of the invention.

Example 1

(Solution/ultrasonic Method)

As a non-conductive elastomer serving as a matrix, a liquid silicone rubber of the one-component cold-crosslinking type (trade name "KE-4.41", manufactured by the Shin-Etsu Chemical Co., Ltd.) was used. As a elastomer particles, there was used a silicone rubber powder obtained in the following manner. An uncrosslinked silicone rubber (trade name "SH861U", manufactured by Toray Dow Corning Co.) in which 0.5 parts of a crosslinking agent (trade name "RC-4", manufactured by Toray Dow Corning Co.) has been added is subjected to thermal pressing at 160° C. for 20minutes to obtain a crosslinked silicone rubber. Then, the resulting crosslinked silicone rubber was ground into particles with a particle size of 50 to 200 $\mu$m by means of a grinding machine to obtain the silicone rubber powder. As conductive particles, spherical carbon particles with a particle size of 1 to 20 $\mu$m, and an average particle size of 5 $\mu$m (trade name "Carbon microbeads ICB-0510", manufactured by Nihon Carbon Co.) were used. As ceramic particles, $\gamma$-$Al_2O_3$ powder (trade name "Asahi Alumina", manufactured by Asahi Chemical Industry Co., Ltd.) with a particle size of 20 to 50 nm, and an average particle size of 30 nm was used. As a dispersion medium, commercially available n-hexane (manufactured by Wako Junyaku Kogyo Co., analytical grade) was used. As the vibrating means, an ultrasonic sending apparatus [180 W, trade name "IKA-SONIC U200S", manufactured by Janke & kunkel GmbH & co.KG (Germany)] was used.

Specifically, 400 mL of the solvent was placed in a 1 L beaker, and the liquid silicone rubber, silicone rubber powder (36 vol %), spherical carbon particles (35.0 vol %), and $\gamma$-$Al_2O_3$ powder (1.0 vol %) were added thereto. Then, the beaker was irradiated with an ultrasonic wave for about 30 minutes to vibrate it, while being placed in the bath of the ultrasonic sending apparatus. Thereafter, the solvent was removed by distillation with an evaporator, and the mixture was sufficiently defoamed. Then, the mixture was transferred to a mold (200 mm×100 mm×2 mm) made of polyethylene to be formed into a sheet. The resulting sheet was directly put in a refrigerator, and allowed to sit at 5° C. for 72 hours. Then, it was allowed to further sit at 10° C. for 72 hours to effect crosslinking.

The deformable conductive elastomer thus obtained was measured for its variation in electric resistance (K·Ω·cm) with respect to the repeated compression deformations. It is noted that this measurement was carried out in accordance with the method described in Japanese Patent Publication No. Hei 7-7607. The results are shown in Table 1 (the number in FIG. 1 is the number of compression).

Figure 2:
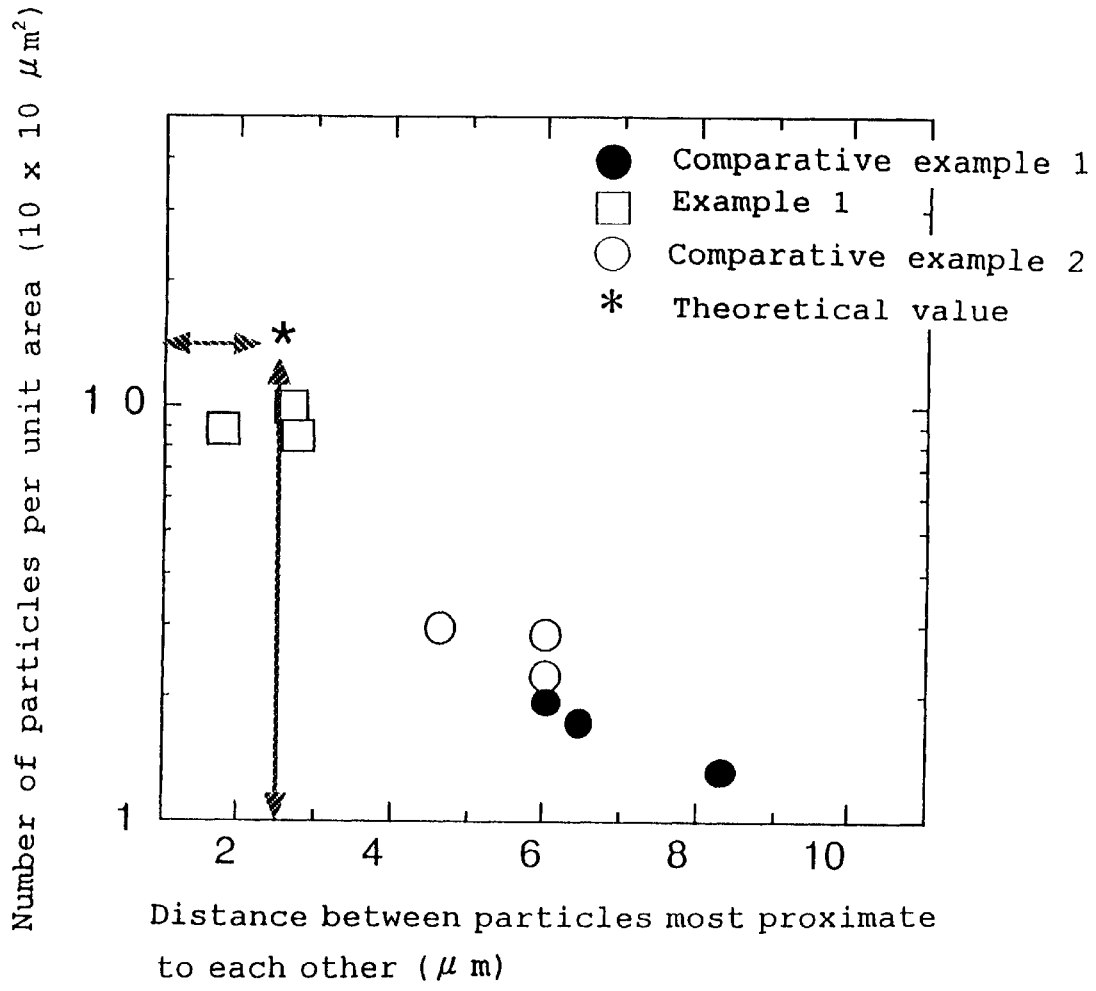
FIG. 2 is a graph showing the number of particles per unit area to the distance between particles most proximate to each other of Example 1 and Comparative Example 1 and Comparative Example 2.
Figure 3:
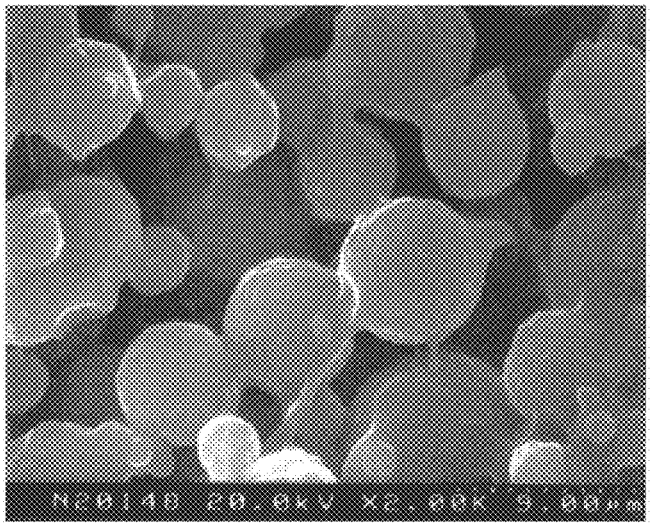
FIG. 3 is a scanning electron microscopic (SEM) photograph showing the vicinity of the spherical carbon particles of Example 1.

Further, the scanning electron microscopic (SEM) photograph was observed to determine the number of particles per unit area (10×10 $\mu m^2$) and the distance between particles most proximate to each other ($\mu$m), thereby investigating the dispersibility of the spherical carbon particles. The results are shown in FIG. 2. FIG. 3 shows the scanning electron microscopic (SEM) photograph in which wetting has been observed at the interface between the silicon rubber matrix and the spherical carbon particles. Further, the results of the tensile test (JIS K 6301) on two deformable conductive elastomers (samples 1 and 2) separately manufactured are shown in Table 1.

TABLE 1

Results of tensile test

| | Comparative Example 1 | Example 1 Sample 1 | Example 1 Sample 2 |
|---|---|---|---|
| Tensile strength (kgf/cm$^2$) | 8.05 | 14.46 | 14.23 |
| Elongation percentage (%) | 68 | 145 | 145 |

Example 2

(Solution/ultrasonic Method)

Figure 4:
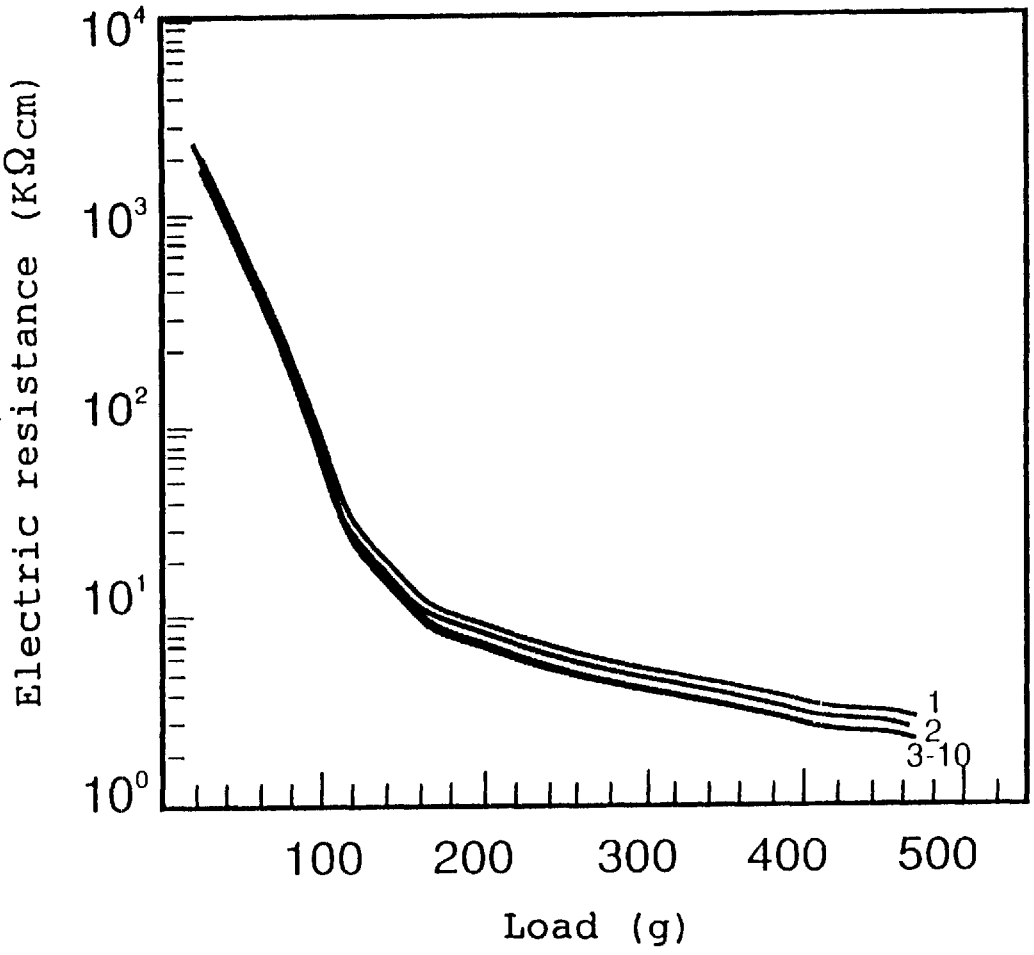
FIG. 4 is a graph showing the electric resistance variation characteristics against the repeated compression deformations of Example 2.

A deformable conductive elastomer was manufactured in the same manner as in Example 1, except that $\beta$-SiC powder (trade name "T 1", manufactured by Sumitomo Osaka Cement Co.) with a particle size of 20 to 50 nm and an average particle size of 30 nm was used as the ceramic particles. The deformable conductive elastomer thus obtained was measured for its variation in electric resistance with respect to the repeated compression deformations in the same manner as in Example 1. The results are shown in FIG. 4 (the number in FIG. 4 is the number of compression).

Comparative Example 1

(Simple Mixing Method)

The same mixing ratio as in Example 1 was adopted, except that the ceramic particles were not added, but a deformable conductive elastomer was manufactured by a method different from Example 1. That is, silicone rubber powder and the spherical carbon particles were previously mixed. Then, liquid silicone rubber was added thereto, and the mixture was kneaded for 5 minutes by means of a mixer (trade name "SC-VS20W", manufactured by Matsushita Electric Industrial Co., Ltd.), to be sufficiently defoamed. The subsequent operations were similar to those of Example 1.

Figure 5:
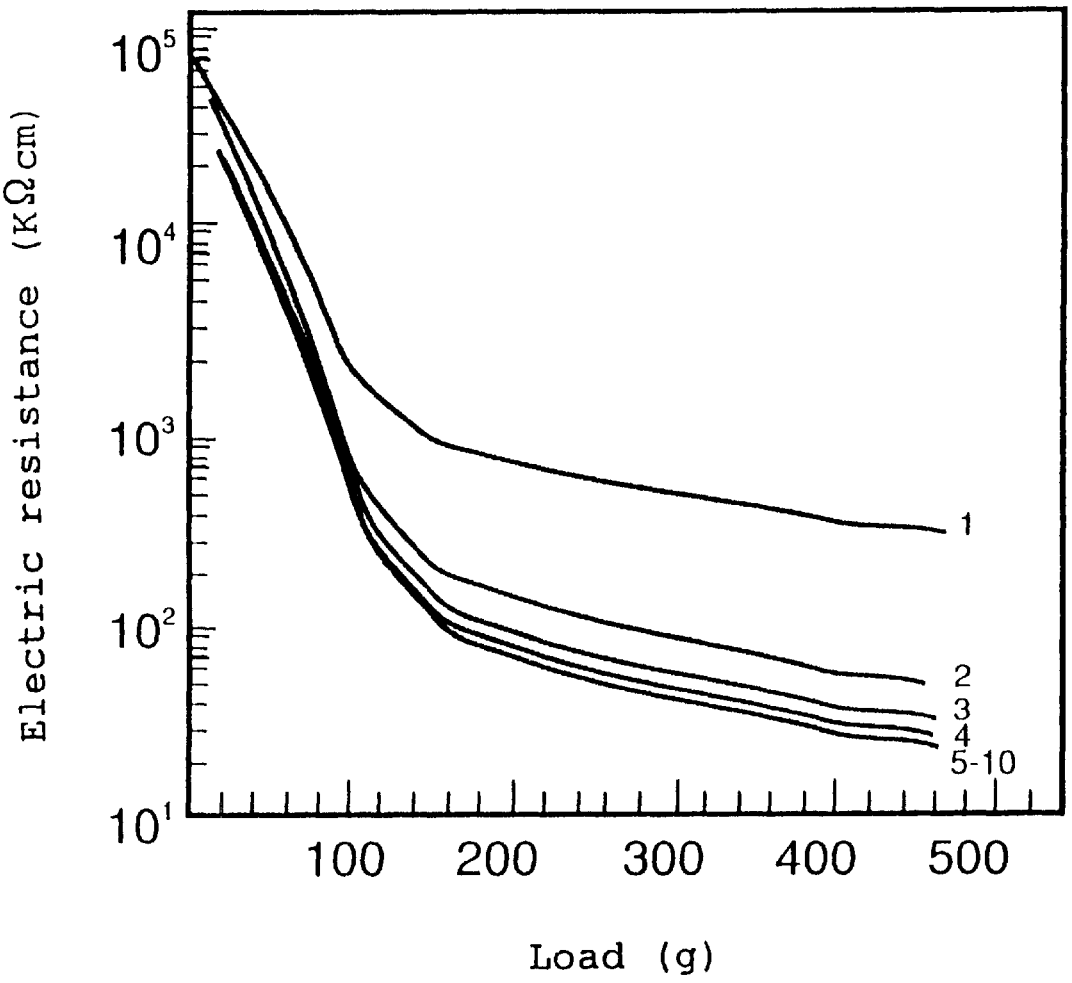
FIG. 5 is a graph showing the electric resistance variation characteristics against the repeated compression deformations of Comparative Example 1.

The resulting deformable conductive elastomer was measured for its variation in electric resistance with respect to the repeated compression deformations, and the number of particles per unit area to the distance between particles most proximate to each other in the same manner as in Example 1. The results are shown in FIG. 5 (the number in FIG. 5 is the number of compression) and FIG. 2. Further, the results of the tensile test, performed in the same manner as in Example 1, are shown in Table 1.

Comparative Example 2

(Solution Method)

A deformable conductive elastomer was manufactured in the same manner as in Example 1, except that stirring only was carried out without ultrasonic irradiation. The number of particles per unit area to the distance between particles most proximate to each other was determined in the same manner as in Example 1. The results are shown in FIG. 2.

As described above, according to the first aspect of the invention of a deformable conductive elastomer, since the conductive particles are almost uniformly dispersed in the non-conductive elastomer, there is an advantage in that the reliability in variation of the electric resistance value is higher. Further, since the elastomer particles are also almost uniformly dispersed, there is another advantage in that the linearity in variations of the electric resistance value, and the mechanical characteristics become more excellent.

According to the second aspect of the invention, the ceramic particles are also almost uniformly dispersed in the non-conductive elastomer. Therefore, there are advantages in that the linearity in variation in electric resistance becomes more excellent, and that the mechanical characteristics such as the elongation percentage and the tensile strength can be improved by an improvement in wettability of the matrix and the conductive particles.

According to the third aspect of the invention, since the non-conductive elastomer is a silicone rubber, there is an advantage in that the heat resistance, aging resistance, tracking resistance, cold resistance, and oil resistance are excellent.

According the fourth aspect of the invention, the silicone rubber is one obtained by crosslinking a mixture of a silicone varnish and an uncrosslinked silicone rubber, or a silicone adhesive containing the silicone varnish and the uncrosslinked silicone rubber as main components, and a liquid silicone rubber. Therefore, there is an advantage in that wettability of the matrix and the conductive particles, and the tear strength of the deformable conductive elastomer can be improved in comparison with the case of the liquid silicone rubber alone.

According to the fifth aspect of the invention, since the elastomer particles are of a silicon rubber powder, there is an advantage in that wettability of the matrix and the elastomer particles are excellent when the non-conductive elastomer is a silicone rubber.

According to the sixth aspect of the invention, since the conductive particles are spherical carbon particles, there is an advantage in that the deformable conductive elastomer exhibits a uniform change in characteristics in three-dimensional directions with respect to every deformation such as compression, elongation, torsion, or bending.

Further, according to the seventh and tenth aspects of the invention relating to the manufacturing method of the deformable conductive elastomer, since the elastomer particles, the conductive particles and the like are mixed and dispersed by vibration in the dispersion medium, and the drying process, there is an advantage in that these can be dispersed more uniformly.

Still further, according to the eighth and eleventh aspects of the invention, since the dispersion medium is a solvent in which the uncrosslinked non-conductive elastomer or the non-conductive elastomer is dissolved, there is an advantage in that dissolution of the uncrosslinked non-conductive elastomer or the non-conductive elastomer into the solvent enables more uniform dispersion of elastomer particles, conductive particles, and the like.

According to the ninth aspect of the invention, since the uncrosslinked non-conductive elastomer is a liquid rubber, or an uncrosslinked rubber varnish, it is easily dissolved in the solvent, or even only the diluting thereof with solvent is sufficient, there is an advantage in that the deformable conductive elastomer can be manufactured more efficiently.

According to the twelfth aspect of the invention, since the non-conductive elastomer is a thermoplastic elastomer varnish, only the diluting thereof with solvent will be sufficient, therefore, there is an advantage in that the deformable conductive elastomer can be manufactured more efficiently, similar to the effect of the ninth aspect.

What is claimed is:

1. A deformable conductive elastomer comprising: a non-conductive elastomer; elastomer particles with a particle size of 10 through 300 $\mu$m; conductive particles with a particle size of 1 through 40 $\mu$m; and ceramic particles with a particle size of 1000 nm or less, each of said elastomer particles, said conductive particles, and said ceramic particles being dispersed in said non-conductive elastomer which is a matrix, wherein non-aggregated ceramic particles are dispersed in said non-conductive elastomer and ceramic particles aggregated with the conductive particles are dispersed in said non-conductive elastomer.

2. The deformable conductive elastomer according to claim 1, wherein said non-conductive elastomer is a silicone rubber.

3. The deformable conductive elastomer according to claim 2, wherein said silicone rubber is the one obtained by crosslinking a mixture of a silicone varnish and an uncrosslinked silicone rubber, or a silicone adhesive containing the silicone varnish and the uncrosslinked silicone rubber as main components, and a liquid silicone rubber.

4. The deformable conductive elastomer according to claim 1, wherein said elastomer particles are of a silicone rubber powder.

5. The deformable conductive elastomer according to claim 1, wherein said conductive particles are spherical carbon particles.

6. The deformable conductive elastomer according to claim 1, wherein the particle size of said ceramic particles is in a range of 20 to 50 nm.

* * * * *